US006022262A

United States Patent [19]

Gill

[11] Patent Number: 6,022,262

[45] Date of Patent: Feb. 8, 2000

[54] PLAYBACK DEVICE FOR A CRIB

[76] Inventor: Jennifer Jane Gill, 31 Harrison Close, Reigate, Surrey RH 2 7H5, United Kingdom

[21] Appl. No.: 09/048,666

[22] Filed: Mar. 26, 1998

[51] Int. Cl.[7] ..... A63H 5/00; A63H 3/33

[52] U.S. Cl. ..... 446/227; 446/297; 446/397; 369/63

[58] Field of Search ..... 446/150, 227, 446/297, 302, 397, 404; 369/63, 64, 65, 68

[56] References Cited

U.S. PATENT DOCUMENTS

| | | | |
|---|---|---|---|
| 4,090,718 | 5/1978 | Grimaldi | 274/1 A |
| 4,363,181 | 12/1982 | Hyman et al. | 40/466 |
| 4,640,034 | 2/1987 | Zisholtz | 40/455 |
| 4,664,640 | 5/1987 | Shindo et al. | 446/227 |
| 4,810,997 | 3/1989 | Kudo et al. | 340/384 E |
| 4,934,079 | 6/1990 | Hoshi | 40/427 |
| 4,968,279 | 11/1990 | Smith | 446/71 |
| 4,973,286 | 11/1990 | Davison | 446/175 |
| 5,313,557 | 5/1994 | Osterhout | 395/2.81 |
| 5,609,508 | 3/1997 | Wingate | 446/142 |
| 5,709,582 | 1/1998 | O'Donnell | 446/227 |
| 5,774,861 | 6/1998 | Spector | 704/275 |
| 5,803,786 | 9/1998 | McCormick | 446/227 |
| 5,806,113 | 9/1998 | McMahan et al. | 5/109 |

*Primary Examiner*—Robert A. Hafer
*Assistant Examiner*—Laura Fossum

[57] ABSTRACT

A playback mechanism is provided including a housing. Also included is a plurality of components each mounted on the housing. Such components including a speaker for transmitting audible signals via free space and a memory connected to the speaker for transmitting the audible signals therefrom. Connected to the memory is an activation switch for playing back audio signals only during the actuation thereof.

2 Claims, 2 Drawing Sheets

PLAYBACK DEVICE FOR A CRIB

BACKGROUND OF THE INVENTION

1. Field of the Invention

The present invention relates to playback mechanisms and more particularly pertains to a new playback device for a crib for selectively playing back one of a plurality of pre-recorded audio messages from a crib-mounted device.

2. Description of the Prior Art

The use of playback mechanisms is known in the prior art. More specifically, playback mechanisms heretofore devised and utilized are known to consist basically of familiar, expected and obvious structural configurations, notwithstanding the myriad of designs encompassed by the crowded prior art which have been developed for the fulfillment of countless objectives and requirements.

Known prior art playback mechanisms include U.S. Pat. Nos. 4,075,771; 4,017,905; 5,433,610; 4,446,495; 4,021,856; and U.S. Patent Des. No. 334,933.

In these respects, the playback device for a crib according to the present invention substantially departs from the conventional concepts and designs of the prior art, and in so doing provides an apparatus primarily developed for the purpose of selectively playing back one of a plurality of pre-recorded audio messages from a crib-mounted device.

SUMMARY OF THE INVENTION

In view of the foregoing disadvantages inherent in the known types of playback mechanisms now present in the prior art, the present invention provides a new playback device for a crib construction wherein the same can be utilized for selectively playing back one of a plurality of pre-recorded audio messages from a crib-mounted device.

The general purpose of the present invention, which will be described subsequently in greater detail, is to provide a new playback device for a crib apparatus and method which has many of the advantages of the playback mechanisms mentioned heretofore and many novel features that result in a new playback device for a crib which is not anticipated, rendered obvious, suggested, or even implied by any of the prior art playback mechanisms, either alone or in any combination thereof.

To attain this, the present invention generally comprises a housing having a circular rear face and a cylindrical side wall integrally coupled to a periphery of the rear face and extending forwardly therefrom. As such, a front peripheral edge and an interior space are defined. A plurality of planar tabs are coupled to an outer surface of the front peripheral edge of the side wall and extended radially therefrom. FIGS. 1 & 2 show a front cover having a disk-shaped configuration including a front surface with a face indicia situated thereon. A rearwardly extending lip is integrally coupled to a periphery of the front cover and extended rearwardly therefrom for removably coupling with the tabs of the side wall. For mounting the housing on a crib of a user, an L-shaped tab is coupled to an upper extent of a back surface of the rear face of the housing. A plurality of components are each mounted within the interior space of the housing. Note FIG. 3. Such components include a microphone for receiving audible signals via free space. Associated therewith is a speaker for transmitting the audible signals via free space. Connected to the speaker is a volume toggle switch for selecting a volume at which the audible signals are transmitted. Also situated within the housing is a memory means connected to the microphone for storing the audible signals received therefrom in a selected one of a predetermined number of available memory slots. Also connected to the memory means is the speaker. By this interconnection, the memory means serves for transmitting audible signals from the selected memory slot. FIG. 3 shows a message selection display connected to the memory means for displaying a number associated with a presently selected memory slot. Associated therewith is a message selection button connected to the memory means for selecting one of the predetermined number of available memory slots. This is accomplished by the subsequent depression of the button which in turn incrementally selects each memory slot. Also connected to the memory means is a record button for allowing the recording of audio signals in the presently selected memory slot via the microphone only during the depression thereof. Finally, an activation switch is situated within the housing and connected to the memory means with a string associated therewith. This string depends downwardly through an aperture formed in a lower end of the side wall of the housing for playing back audio signals in the presently selected memory slot via the speaker only during the pulling thereof.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new playback device for a crib apparatus and method which has many of the advantages of the playback mechanisms mentioned heretofore and many novel features that result in a new playback device for a crib which is not anticipated, rendered obvious, suggested, or even implied by any of the prior art playback mechanisms, either alone or in any combination thereof.

It is another object of the present invention to provide a new playback device for a crib which may be easily and efficiently manufactured and marketed.

It is a further object of the present invention to provide a new playback device for a crib which is of a durable and reliable construction.

An even further object of the present invention is to provide a new playback device for a crib which is susceptible of a low cost of manufacture with regard to both materials and labor, and which accordingly is then susceptible of low prices of sale to the consuming public, thereby making such playback device for a crib economically available to the buying public.

Still yet another object of the present invention is to provide a new playback device for a crib which provides in the apparatuses and methods of the prior art some of the advantages thereof, while simultaneously overcoming some of the disadvantages normally associated therewith.

Still another object of the present invention is to provide a new playback device for a crib for selectively playing back one of a plurality of pre-recorded audio messages from a crib-mounted device.

Even still another object of the present invention is to provide a new playback device for a crib that includes a housing. Also included is a plurality of components each mounted on the housing. Such components including a speaker for transmitting audible signals via free space and a memory connected to the speaker for transmitting the audible signals therefrom. Connected to the memory is an activation switch for playing back audio signals only during the actuation thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
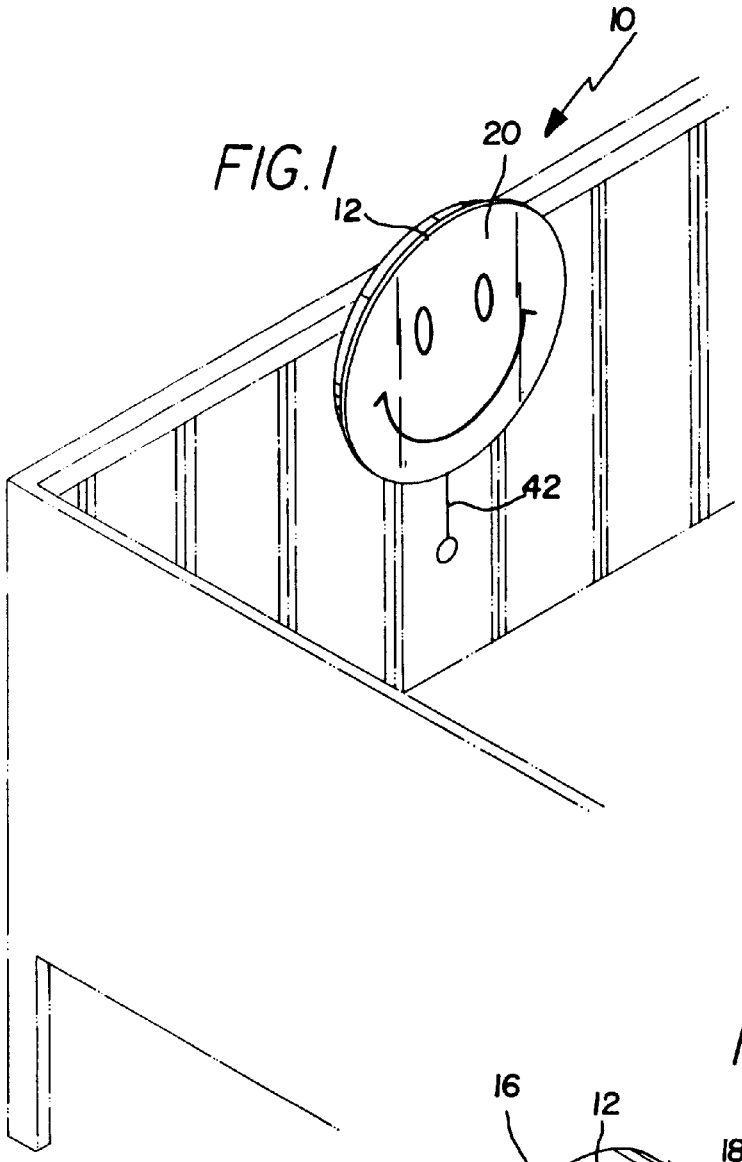
FIG. 1 is a perspective view of a new playback device for a crib according to the present invention.

With reference now to the drawings, and in particular to FIGS. 1 through 4 thereof, a new playback device for a crib embodying the principles and concepts of the present invention and generally designated by the reference numeral 10 will be described.

The present invention, designated as numeral 10, includes a housing 12 having a circular rear face 14 and a cylindrical side wall 16 integrally coupled to a periphery of the rear face and extending forwardly therefrom. As such, a front peripheral edge and an interior space are defined. A plurality of planar tabs 18 are coupled to an outer surface of the front peripheral edge of the side wall and extended radially therefrom. While the housing is shown quite large in the Figures for clarity, it should be noted that a diameter of the housing is preferably 12 cm.

Figure 2:
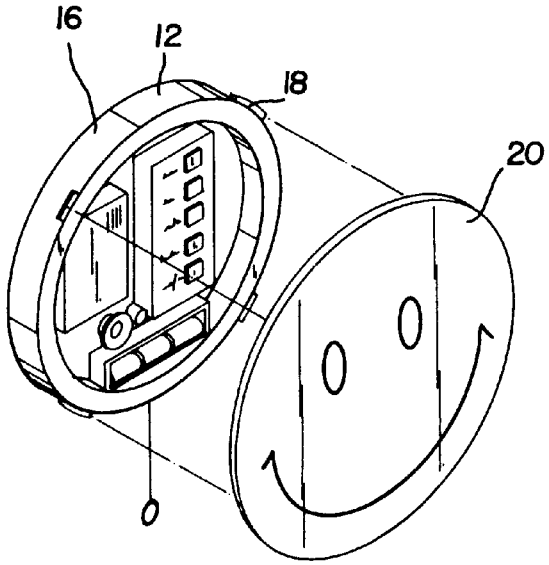
FIG. 2 is an exploded perspective view of the present invention.

FIGS. 1 & 2 show a front cover 20 having a disk-shaped configuration including a front surface with a face indicia situated thereon. A rearwardly extending lip is integrally coupled to a periphery of the front cover and extended rearwardly therefrom for removably coupling with the tabs of the side wall. Unillustrated slots are preferably formed in the rearwardly extending lip for coupling with the tabs. For mounting the housing on a crib of a user, an L-shaped tab 24 is coupled to an upper extent of the rear face of the housing.

A plurality of components are each mounted within the interior space of the housing. Note FIG. 3. Such components include a microphone 26 for receiving audible signals via free space. Associated therewith is a speaker 28 for transmitting the audible signals via free space. Connected to the speaker is a volume toggle switch 30 for selecting a volume at which the audible signals are transmitted.

Also situated within the housing is a digital memory means 32 connected to the microphone for storing the audible signals received therefrom in a selected one of a predetermined number of available memory slots. Also connected to the memory means is the speaker. By this interconnection, the memory means serves for transmitting audible signals from the selected memory slot.

Figure 3:
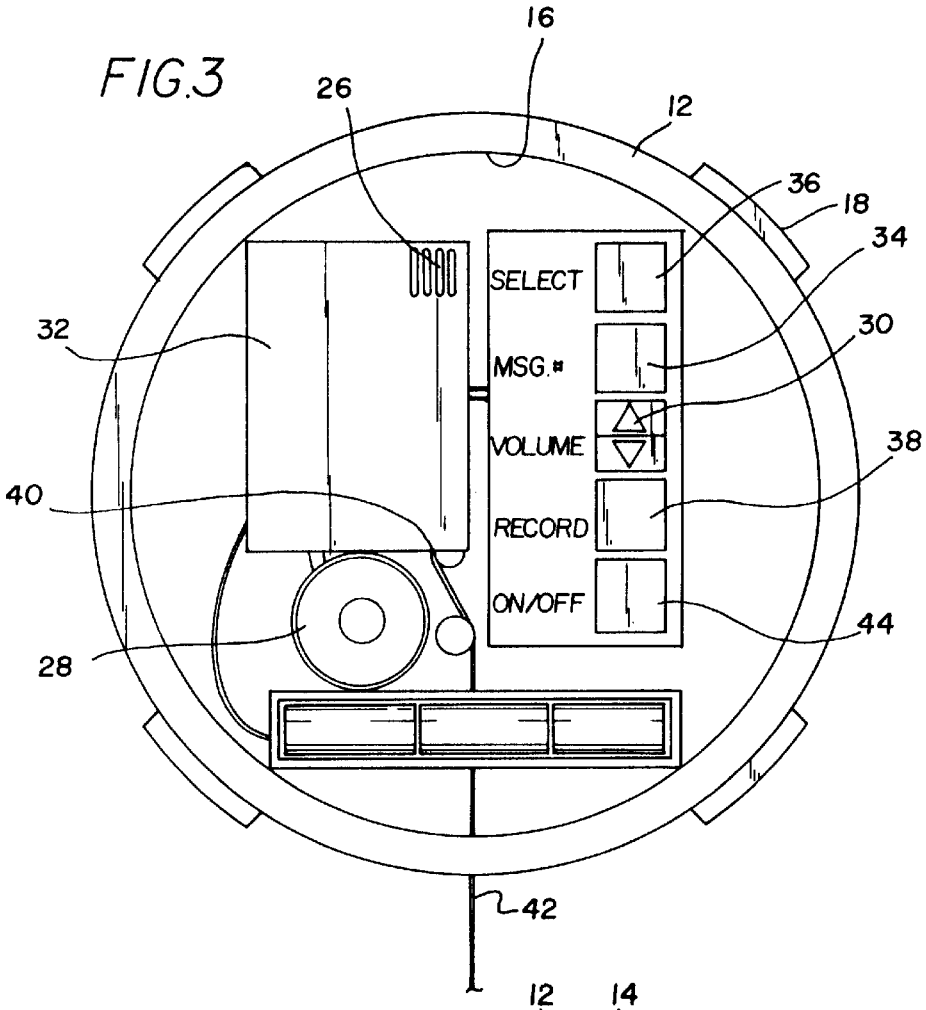
FIG. 3 is a front view of the interior space of the housing of the present invention.
Figure 4:
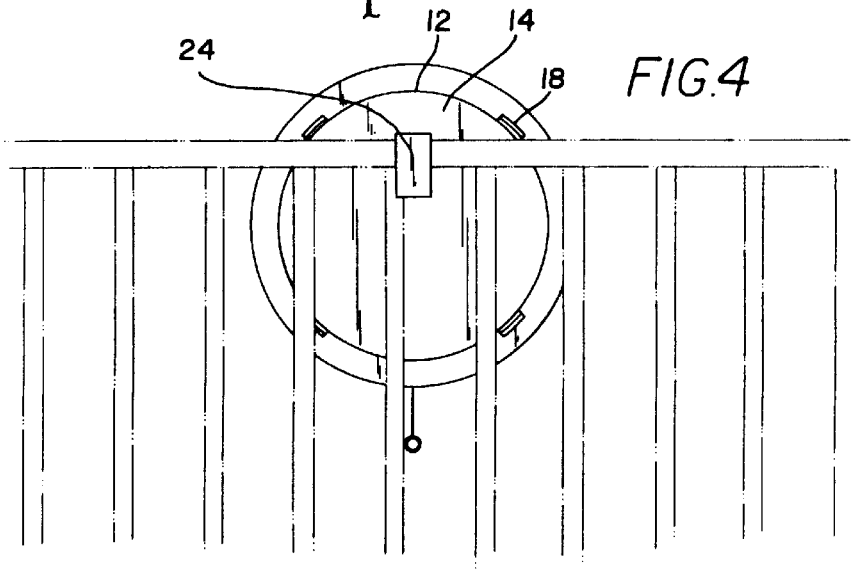
FIG. 4 is a rear view of the present invention in use.

FIG. 3 shows a digital message selection display 34 connected to the memory means for displaying a number associated with a presently selected memory slot. Associated therewith is a message selection button 36 connected to the memory means for selecting one of the available memory slots. This is accomplished by the subsequent depression of the button which in turn incrementally selects each memory slot. Once the last memory slot is selected, another depression of the selection button effects the selection of the first memory slot.

Also connected to the memory means is a record button 38 for recording audio signals in the presently selected memory slot via the microphone only during the depression thereof.

Finally, an activation switch 40 is situated within the housing and connected to the memory means with a string 42 associated therewith. This string depends downwardly through an aperture formed in a lower end of the side wall of the housing. When the string is pulled, the activation switch effects the playback of audio signals in the presently selected memory slot via the speaker. For facilitating the pulling of the cord, a rigid loop is preferably mounted on a lower end thereof.

It should be note that the memory means is adapted to automatically "rewind" the current memory slot after being actuated. As an option, an on/off switch 44 may be included to unconditionally deactivate the present invention. As shown in FIG. 3, each of the selection oriented components are configured in a vertical column which is accessible upon the removal of the front cover.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A playback mechanism for a baby crib, comprising:

a housing having a rear face, a side wall coupled to a periphery of the rear face and extending forwardly therefrom for defining a front peripheral edge and an interior space, a plurality of planar tabs coupled to an outer surface of the front peripheral edge of the side wall and extending radially therefrom, a front cover having a face indicia situated thereon, a rearwardly extending lip coupled to a periphery of the front cover and extending rearwardly therefrom for removably coupling with the tabs of the side wall, and an L-shaped tab coupled to an upper extent of a back surface of the rear face of the housing for mounting on a crib of a user; and a plurality of components each mounted in the interior space of the housing, the components including:

a microphone for receiving audible signals via free space, a speaker for transmitting the audible signals via free space, a volume toggle switch connected to the speaker for selecting a volume at which the audible signals are transmitted, memory means connected to the microphone for storing the audible signals received therefrom in a selected one of a predetermined number of available memory slots and connected to the speaker for transmitting audible signals from the selected memory slot, a message selection display connected to the memory means for displaying a number associated with a presently selected memory slot, a message selection button connected to the memory means for selecting one of the predetermined number of available memory slots by the subsequent depression thereof which in turn incrementally selects each memory slot, a record button connected to the memory means for allowing the recording of audio signals in the presently selected memory slot via the microphone only during the depression thereof, and an activation switch connected to the memory means with a string associated therewith which depends downwardly through an aperture formed in a lower end of the side wall of the housing for playing back audio signals in the presently selected memory slot via the speaker only during the pulling thereof.

2. A playback mechanism for a baby crib comprising, in combination:

a housing having a circular rear face, a cylindrical side wall integrally coupled to a periphery of the rear face and extending forwardly therefrom for defining a front peripheral edge and an interior space, a plurality of planar tabs coupled to an outer surface of the front peripheral edge of the side wall and extending radially therefrom, a front cover having a disk-shaped configuration with a front surface with a face indicia situated thereon, a rearwardly extending lip coupled to a periphery of the front cover and extending rearwardly therefrom for removably coupling with the tabs of the side wall, and an L-shaped tab coupled to an upper extent of a back surface of the rear face of the housing for mounting on a crib of a user; and a plurality of components each mounted within the interior space of the housing, the components including:

a microphone for receiving audible signals via free space, a speaker for transmitting the audible signals via free space, a volume toggle switch connected to the speaker for selecting a volume at which the audible signals are transmitted, memory means connected to the microphone for storing the audible signals received therefrom in a selected one of a predetermined number of available memory slots and connected to the speaker for transmitting audible signals from the selected memory slot, a message selection display connected to the memory means for displaying a number associated with a presently selected memory slot, a message selection button connected to the memory means for selecting one of the predetermined number of available memory slots by the subsequent depression thereof which in turn incrementally selects each memory slot, a record button connected to the memory means for allowing the recording of audio signals in the presently selected memory slot via the microphone only during the depression thereof, and an activation switch connected to the memory means with a string associated therewith which depends downwardly through an aperture formed in a lower end of the side wall of the housing for playing back audio signals in the presently selected memory slot via the speaker only during the pulling thereof.

* * * * *